US005434331A

United States Patent [19]

Barkatt et al.

[11] Patent Number: 5,434,331

[45] Date of Patent: Jul. 18, 1995

[54] REMOVAL OF RADIOACTIVE OR HEAVY METAL CONTAMINANTS BY MEANS OF NON-PERSISTENT COMPLEXING AGENTS

[75] Inventors: Aaron Barkatt, Silver Spring; Stephanie A. Olszowka, Derwood, both of Md.

[73] Assignee: The Catholic University of America, Washington, D.C.

[21] Appl. No.: 977,506

[22] Filed: Nov. 17, 1992

[51] Int. Cl.[6] ..... G21F 9/00; C23G 1/02

[52] U.S. Cl. ..... 588/1; 588/20; 134/3; 134/10; 134/12; 134/41; 376/309; 376/310; 976/DIG. 376; 423/20; 210/682; 210/688

[58] Field of Search ..... 134/3, 10, 12, 41; 210/682, 688; 376/309, 310; 423/9, 20; 976/DIG. 376; 588/1, 20

[56] References Cited

U.S. PATENT DOCUMENTS

| | | | |
|---|---|---|---|
| 3,047,434 | 7/1962 | Bulat | 134/1 |
| 3,821,351 | 6/1974 | Lucid | 423/9 |
| 3,853,618 | 12/1974 | Smith | 134/3 |
| 3,900,551 | 8/1975 | Baroncelli et al. | 423/9 |
| 4,144,149 | 3/1979 | Bollhalder et al. | 204/149 |
| 4,222,892 | 9/1980 | Motojima et al. | 252/428 |
| 4,636,336 | 1/1987 | Gay et al. | 252/632 |
| 4,693,833 | 9/1987 | Toshikuni et al. | 210/759 |
| 4,741,887 | 5/1988 | Coleman et al. | 423/112 |
| 4,882,132 | 11/1989 | Monzyk et al. | 423/139 |
| 4,975,253 | 12/1990 | Monzyk et al. | 423/139 |
| 5,039,496 | 8/1991 | Kehl et al. | 423/24 |
| 5,122,268 | 6/1992 | Burack et al. | 210/202 |
| 5,225,087 | 7/1993 | Kardos | 210/713 |
| 5,260,039 | 11/1993 | Schwab et al. | 423/24 |

OTHER PUBLICATIONS

J. A. Ayres, "Decontamination of Nuclear Reactors and Equipment", (1970) (section discussing use of secondary constituents in decontamination solutions).

J. Severa et al., Handbook of Radioactive Contamination and Decontamination, Studies in Environmental Science, 47, (1991 (section discussing requirements for decontaminating agent).

J. M. Cleveland, C&EN, Apr. 13, 1981, p. 63.

J. M. Jevec et al., "Chemical Cleaning Solvent and Process Testing," EPRI NP-2976 Apr. 1983.

D. Schneidmiller and D. Stiteler, "Steam Generator Chemical Cleaning Process Development", EPRI NP-3009 Apr. 1983.

D. C. Berndt et al., "The Kinetics and Mechanism of the Hydrolysis of Benzohydroxamic Acid", J. Org. Chem., 31, 3312-3314 (1966).

I. De Paolini, Gazz. Chim. Ital, 56, 757 (1926).

M. Schenck, Ber., 77, 29 (1944).

F. Klages, R. Heinle, H. Sitz and E. Specht, Chem. Ber., 96, 2387-2393 (1963) (non english language).

Radiac TM (Adam Lab) detergent product insert.

D. M. Romanova et al, Tr. Inst. Met. Obogashch., Akad., Nauk Kaz. SSR 1972, No. 48, pp. 37-42, Chem. Abstr. 80:95161w (1973).

F. Vernon et al., "Chelating Ion-Exchangers Containing N-substituted Hydroxylamine Functional Groups", Anal. Chim. Acta, 94, 317-322 (1977).

(List continued on next page.)

*Primary Examiner*—Ngoclan T. Mai

*Attorney, Agent, or Firm*—Cushman, Darby & Cushman

[57] ABSTRACT

A process for the decontamination of solid surfaces contaminated with radioactive or heavy metal species using a solution based on one or more non-persistent complexing agents, or for the chemical cleaning of steam generator sludge using such a solution, or for removing radioactive or heavy metal species from a solution using a combination of a one or more non-persistent complexing agents and a solid support, followed in each case by thermal or thermal-chemical treatment to decompose said non-persistent complexing agent. The preferred non-persistent complexing agents are hydroxamic acids, and the most preferred is acetohydroxamic acid.

29 Claims, No Drawings

OTHER PUBLICATIONS

Bhatnagar et al., Proc. Ion-Exch, Symp. 1978, pp. 37-39 Chem. Abstr., 91:141485c (1979).

V. Grdinic et al., "Hydroxamic Cellulose Fibre as a Chelating Cation Exchanger", Croat. Chem. Acta, 54, 109-113 (1981).

F. Vernon, "Chelating Ion Exchangers—The Synthesis and Use of Poly(Hydroxamic Acid) resins", Pure Appl. Chem., 54, 2151-2158 (1982).

F. Vernon et al., "The Extraction of Uranium from Seawater by Poly(Amidoxime)/Poly(Hydroxamic Acid) Resins and Fibre", React. Polym., 1, 301-308 (1983).

Vertinskaya et al., Russ. J. Anal. Chem., 40, 1387-1393 (1985) 104:27988f.

Shah et al., "Synthesis, Characterization & Analytical Properties of New Poly(Hydroxamic Acid) Chelating Resins", Ind. J. Chem., 25A, 506-508, (1986).

Mendez et al., "Synthesis, Characterization and Analytical Application of a Hydroxamic Acid Resin", Talanta, 37, 591-594 (1990).

"Occupational Health Guideline for Hydrogen Peroxide", U.S. Dept. of Health and Human Services, 1978.

"Hydrogen Peroxide" in *Dangerous Properties of Industrial Materials,* 7th Edition, vol. III by Sax and Lewis (Van Nostrand Reinhold, 1989) pp. 1910-1911.

REMOVAL OF RADIOACTIVE OR HEAVY METAL CONTAMINANTS BY MEANS OF NON-PERSISTENT COMPLEXING AGENTS

BACKGROUND OF THE INVENTION

1. Field of the Invention

The present invention relates, in general to a process of removing radioactive or heavy metal contamination. In particular, the present invention relates to a process for decontaminating solid surfaces; to a chemical cleaning of steam generator sludge; and to a process for removing radioactive or heavy metal contamination from solutions.

2. Background Information

Many industrial processes result in the generation of undesirable solids or liquid waste streams containing hazardous metal species in forms such as solid oxides and dissolved ions. In particular, this pertains to the nuclear industry and to facilities which make use of radioisotopes, where the generation of wastes and of other undesirable materials, such as corrosion products accumulated on or around metal surfaces, requires continuous efforts to ensure that radioactive species present in such wastes or undesirable materials will not be released to the environment at levels capable of producing significant health risk or environmental damage. One common example of the need for effective control of radioactive species is the decontamination of surfaces of equipment in facilities using radio-isotopes. Another one is cleaning steam generators in nuclear power stations, where the accumulation of sludge is the cause of serious operational problems. Nuclear power plants and other facilities also generate liquid waste streams that require removal of radioactive contaminants.

Present techniques of managing radioactive contamination involve extensive use of complexing and chelating agents. The problem of decontaminating metal surfaces contaminated with radioactive species has been addressed using a relatively small number of chemical decontaminating agents. These can be divided, in general, into several major categories, which include pH control agents (acids, bases or buffers), oxidizing agents such as hydrogen oxide or potassium permanganate and reducing agents such as hydrazine, complexing or chelating agents, such as oxalate, citrate, gluconate, picolinate, and ethylenediaminetetraacetic acid (EDTA), and surfactants. Certain additives can have more than one role. For instance, ammonia and its salts can function both to control the pH and to act as complexing agents for certain metals such as copper. In addition, secondary constituents of decontaminating solutions include emulsifiers, corrosion inhibitors, etc. [J. A. Ayres, Decontamination of Nuclear Reactors and Equipment, The Ronald Press Company, New York, N.Y., 1970.] A typical decontamination operation may consist of several mechanical and chemical treatment steps.

The main requirements which a decontaminating agent should meet have been recently outlined. [J. Severa and J. Bar, Handbook of Radioactive Contamination and Decontamination, Studies in Environmental Science 47, Elsevier, Amsterdam, 1991.] In addition to being effective in removing contaminants from the metal surfaces of interest, a decontaminating agent should not be excessively corrosive and should be easy to prepare and to apply. The extent of surface corrosion caused by these agents should be controllable. No less important are considerations related to the environmental impact of the decontaminating agent itself. The presence of the decontaminating agent should not create excessive difficulties in treating the resulting waste stream, nor should this agent constitute a pollutant or promote pollution by other agents.

Most decontaminating agents do not fully meet all of these criteria. A major example of the resulting complications is provided by the widespread use of EDTA. EDTA is a highly effective chelating agent which is relatively easy to prepare, given proper control of the pH and temperature during its dissolution in water, and it does not pose serious health hazards.

Bulat (U.S. Pat. No. 3,047,434) describes a solution for radioactive decontamination comprising a mixture of water, EDTA, sodium sulfate, sodium hydroxide, manganese dioxide and carbon black, and a decontamination method which comprises immersing a radioactively contaminated article in such a solution, and subjecting the combination to ultrasonic vibration forces sufficient to produce cavitation. In addition to manganese dioxide and carbon black, other solids mentioned as being of possible use as ingredients of decontamination solutions are silicates such as colloidal clay, talc, fuller's earth, chalk, sulfides of arsenic and antimony, diatomaceous earth, and metallic oxides such as alumina, magnesia, iron oxide and titanium dioxide.

However, the presence of EDTA or of other stable complexing or chelating agents, in a waste stream contaminated with radioactive species poses major problems when attempts are made to reduce the volume of the waste stream by removing these contaminants with ion exchange or sorption beds. The presence of EDTA hinders the immobilization of the liquid waste in cement or epoxy media and limits the amount of volume reduction which can be achieved in this operation. Furthermore, the presence of EDTA at a disposal site dramatically enhances the dissolution of actinides in groundwater and their transport away from the site. [J. M. Cleveland, C&EN, Apr. 13, 1981, p.63.] Both federal and state regulations restrict the concentrations of chelating agents in solidified low-level waste forms, thus limiting achievable volume reduction factors with respect to spent decontamination media. It would be highly desirable to destroy the EDTA in the waste stream before attempting solidification or removal of radionuclides. However, EDTA has very high thermal and hydrolytic stability, and its destruction requires the use of very severe conditions, such as oxidation with hot concentrated hydrogen peroxide or incineration.

Another area of nuclear technology which involves the use of complexing and chelating agents is the removal of sludge from steam generators of nuclear power stations. Conventional techniques of sludge removal from steam generators in the nuclear industry are based on mechanical means (water jet lancing) alone. Mechanical cleaning is, in general, only partially effective within the time available for steam generator cleaning during outages.

Various methods of chemical cleaning have been developed and tested both in the USA and abroad with a view to enhancing the effectiveness of sludge removal. The EPRI/SGOG process, which involves treatment with an EDTA-based iron solvent followed by an ethylenediamine(EDA)-based copper solvent, [J. M. Jevec and W. S. Leedy, Chemical Cleaning Solvent and Process Testing, EPRI NP-2976, April 1983; D. Schneidmiller and D. Stiteler, Steam Generator Chemical Cleaning Process Development, EPRI NP-3009, April 1983] is the only process currently approved for use in USA power stations. The EPRI/SGOG process has already been used in full scale steam generator cleaning at several power stations. However, the use of the EPRI/SGOG process generates large volumes of radioactively contaminated concentrated EDTA solutions containing high levels of Fe, Cu and other metals. Disposal of such spent solutions is complicated and expensive because EDTA is highly resistant to thermal decomposition and oxidation, poses major difficulties during waste solidification, and is subject to severe regulatory restrictions on its concentration in solidified wastes when such wastes are shipped to radioactive waste burial sites.

The use of complexing and chelating agents on solids supports has been described. For instance, U.S. Pat. No. 4,222,892, by Motojima et al., describes a process for adsorbing oxine (8-hydroxyquinoline) on activated charcoal and using the complex to remove radionuclides from the cooling water and leakage-water of nuclear reactors. A mention is also made of a method of removing heavy metals such as mercury, copper, chromium, etc., from a water solution containing the heavy metals using an activated charcoal or silica gel on which oxine is adsorbed and carried. However, as in the cases of spent decontamination media and the streams generated upon chemical cleaning of contaminated steam generator sludge, the presence of complexing or chelating agents together with radioactive contaminants in the secondary waste generated in the process, i.e., the spent oxine-impregnated charcoal, greatly complicates the disposal of this secondary waste in a burial site.

This invention relates to the use of non-persistent complexing agents, in particular hydroxamic acids, as substitutes for conventional complexing or chelating agents in cleaning operations involving hazardous metal species, in particular radioactive metal species, with a view to minimizing the amount of secondary wastes resulting from said cleaning operations.

SUMMARY OF THE INVENTION

The present invention relates to a method of removing radioactive or heavy metal contamination.

It is an object of the present invention to provide a method of decontaminating solid surfaces.

It is another object of the present invention to provide a method of chemical cleaning of steam generator sludge.

It is a further object of the present invention to provide a method for removing radioactive or heavy metal contamination from solutions.

Further objects and advantages of the present invention will be clear from the description that follows.

DETAILED DESCRIPTION OF THE INVENTION

The present invention uses a composition in which a non-persistent complexing agent, defined as a complexing agent capable of being substantially decomposed by means of thermal or thermal-chemical treatments at a temperature in the range of about 20°C. -120° C., preferably in the range of about 20° C.-100° C., in solution or on a solid support, to effect or assist in the cleaning of solids or liquid streams contaminated with radioactive species or with heavy metals. The non-persistent complexing agent of the present invention is subsequently substantially decomposed by means of thermal or chemical-thermal treatments at a temperature not exceeding about 120° C., preferably not exceeding about 90°-100° C., leaving behind the contaminants in a medium which is substantially free of the complexing agent, thereby facilitating the disposal of the contaminants. Substantially decomposed, as used herein, refers to a reduction greater than 95% of the non-persistent complexing agent, preferably a reduction greater than 98% of the non-persistent complexing agent.

A preferred chemical-thermal treatment comprises decomposing the non-persistent complexing agent of the present invention by adding acid in solution and heating at about 90°-100° C. for about 1-2 hours, or until the non-persistent complexing agent is substantially decomposed. Typical acids include, but are not limited to, hydrochloric, nitric and sulfuric acid, which may be added to a concentration of a few weight percent. Preferably 0.1-10 wt %, more preferably 1-5 wt %. Another chemical-thermal treatment applicable in the present invention comprises passing the solution through a column or bed of manganese dioxide, preferably, activated manganese dioxide, with a residence time not exceeding about 1 hour, at a temperature of about 20°-100° C., preferably about 50°-100° C.

The non-persistent complexing agents, according to the present invention, are generally defined as those agents which may be used as complexing or chelating agents for radioactive or heavy metals, which may be decomposed after use. The agents applicable in the present invention may be decomposed under mild conditions by thermal or chemical-thermal treatment. Such treatment may include, but is not limited to, treatment with not more than 5% acid with or without heating for less than about 2 hours, or treatment with mild oxidizing solids, such as, but not limited to, manganese dioxide at less than about 120° C. Such agents are those which decompose by heating in air in the range of between about 20° C.-170° C., preferably in the range of about 30° C.-170° C., for less than about one hour. Specific embodiments are detailed herein.

The non-persistent complexing agent of the present invention is preferably a hydroxamic acid, preferably selected from the group of salicylhydroxamic, mandelohydroxamic, and acetohydroxamic acids, and most preferably acetohydroxamic acid. Sulfosalicylic acid may also be used in the present invention as a non-persistent complexing agent. Following use in binding or interacting with radioactive or heavy metal species, the non-persistent complexing agent is substantially decomposed by subjecting it to chemical treatments, such as acidification or mixing with solid manganese dioxide, and heating it at temperatures not exceeding about 120° C., preferably not exceeding 100° C., prior to final disposal of the radioactive or heavy metal contaminants. As used herein, radioactive contaminants may be preferably activation products, for example, $Mn^{54}$, $Co^{58}$, $Co^{60}$, etc., while heavy metal contaminants may be, for example, mercury, chromium, copper, cadmium, lead, etc.

The present invention provides a method in which the complexing agent is eliminated prior to disposal of the contaminants, thereby reducing the risk of subsequent complexant-assisted release and migration of contaminants from the site of their disposal. The present invention further permits a higher volume reduction in packaging the contaminants in a solid matrix for their ultimate disposal when compared to prior art methods.

One skilled in the art will appreciate that the present invention may be combined with mechanical means such as mixing, ultrasonics, spraying, wiping, scrubbing, etc., to increase the contact between the contaminated articles or solutions and the decontaminating solutions as described herein, without departing from the scope of the present invention.

The preferred non-persistent complexing agents according to this invention are hydroxamic acids, most preferably acetohydroxamic acid. Such acids may be available in stable form or, as is the case with formhydroxamic acid, be prepared in situ in the medium in which they are to be used. Although hydroxamic acids are known to be susceptible to decomposition by thermal or thermal-chemical treatments, this property has not been utilized previous to the present invention in applications related to the removal of radioactive or heavy metal contaminants from surfaces, solids or liquid streams. D. C. Berndt and R. L. Fuller showed that hydroxamic acids undergo hydrolysis in the presence of strong acids or strong bases (J. Org. Chem., 31, 3312–3314 (1966)). However, the use of a strong acid or a strong base to promote the thermal decomposition of hydroxamic acids requires heating of the entire solution and subsequent neutralization of the acid or base prior to further treatment of the resulting stream. I. De Paolini (Gazz. Chim. Ital., 56, 757 (1926)) and M. Schenck (Ber., 77, 29 (1944)) reported that hydroxamic acids can also be oxidized using strong oxidizing agents, viz. mercuric oxide or periodate. F. Klages, R. Heinle, H. Sitz and E. Specht (Chem. Ber., 96, 2387–2393 (1963)) showed that compounds related to hydroxamic acids, such as O-acetylphthaloxime, can also be oxidized by very strong oxidizing agents such as lead dioxide, chromium trioxide and potassium permanganate. However, all of the oxidizing agents listed in the aforementioned reports are expensive, toxic, or both expensive and toxic, and in several cases (periodate, potassium permanganate) they are soluble in aqueous media and require heating of the entire solution.

The present applicants have found, surprisingly, that the relatively mild, inexpensive and low-hazard manganese dioxide can be used in solid form to oxidize hydroxamic acids, in particular acetohydroxamic acid, even at temperatures not exceeding about 100° C. Furthermore, manganese dioxide is found to be effective in the form of activated grains, which can be used in the form of a packed column or bed, thereby minimizing the volume which requires heating and making it possible to conduct the decomposition of hydroxamic acids in a continuous mode rather than in batch mode. One skilled in the art will appreciate that the choice of batch or continuous operation are dependent on many factors which are applications specific and both operations are within the scope of the instant invention.

For the purpose of the present invention, a solution based on non-persistent complexing agents is defined as a solution which contains at least about 0.1% (wt./vol. %) preferably at least about 1% (wt./vol. %), non-persistent complexing agents, preferably hydroxamic acids, and in which the ratio of the concentrations of such complexing agents to those of other organic complexing or chelating agents is at least about 10:1, preferably at least about 100:1. The upper limit of complexing agent in solution according to the present invention may be determined by solubility, reasonably considered about 50%, or when a solid support is used, as determined by weight sorbed. The solution according to the present invention may contain aqueous or organic solvents without departing from the scope of the present invention.

In one embodiment, the present invention relates to a method to decontaminate solid surfaces using decontamination solutions based on non-persistent complexing agents, preferably hydroxamic acids, and substantially decompose said non-persistent complexing agents by means of thermal or chemical-thermal treatments prior to final disposal of the radioactive or heavy metal contaminants. As used herein, decontamination refers to about 70–100% removal, preferably 85–100% removal, more preferably 95–100% removal, or most preferably, greater than 99% removal.

More specifically, in this embodiment, the present invention relates to a method of decontaminating solid surfaces comprising the steps of:

(a) contacting a surface contaminated by radioactive or heavy metals species, with a decontamination solution comprising a non-persistent complexing agent and any one or a combination of pH control agents, oxidizing agents, reducing agents, surfactants, emulsifiers and corrosion inhibitors, at a temperature of between 5° C. and 120° C., preferably between 5° C. and 100° C. for a period of time sufficient to reduce the decontamination by approximately 70–100%, preferably 85–100%, more preferably 95–100%, most preferably, by greater than 99%.

(b) collecting and heating the solution from step (a) to a temperature in the range of about 20° C.–120° C., preferably about 20° C.–100° C. such that substantial decomposition of the non-persistent complexing agent is achieved, wherein said collecting and heating may further comprise any one of the following additional steps:

(i) adding one or more acidic solutes, such as hydrochloric acid or nitric acid, to the collected solution, prior to heating, (ii) adding one or more basic solutes to the collected solution, prior to heating, (iii) adding one or more oxidizing solutes to the collected solution, prior to heating, (iv) adding one or more solid reagents or catalysts, such as manganese dioxide to the collected solution, prior to heating, (v) heating, fully or in part, the collected solution while passing the solution through a packed column or bed containing one or more solid reagents or catalysts, such as manganese dioxide;

(c) separating the radioactive or heavy metal species from the solution resulting from step (b) such that the resulting solution is substantially free of radioactive or heavy metal contamination by contacting the solution from step (b) with one or more sorption or ion exchange media in batch or in continuous mode by passing the solution from step (b) through, or mixing with, a packed column or bed containing the sorption or ion exchange media, or by distilling the solution from step (b) completely or in part to retain the radioactive or heavy metal contaminants within the distillation bottoms, wherein, a clean second solution is formed; and (d) disposing of the clean second solution.

Substantial decomposition, as used herein, refers to a reduction of greater than 95% of the non-persistent complexing agent, preferably greater than 98% of the non-persistent complexing agent. Substantially free of contamination, as used herein, refers to a final contamination of greater than 70% reduction, preferably greater than 85% reduction, more preferably, greater than 95% reduction, and most preferably, greater than 99% reduction.

The solid reagent or catalyst of step b(iv) or b(v), above, such as manganese dioxide, may be regenerated after contact with solution, for instance, by heating in air, oxygen enriched gas or a gas consisting essentially of oxygen.

One skilled in the art will appreciate that the oxidizing agents according to the present invention may be, for example, potassium permanganate; the reducing agents may be, for example, hydrazine, and the pH control agents may be any of acids, bases or buffers. Typical compositions of these additives which will be useful in the present invention will be recognized by one skilled in the art. A typical additive solution known in the art, is Radiac Wash TM (Adam Lab) detergent which is recommended for decontamination of liquid radioactive and general laboratory spills.

Further, step (c) according to the present embodiment may comprise impregnating the solution of step (b) into a solid matrix, such as cement or a polymer, without separating out the radioactive or heavy metal contaminants. In this form of the present embodiment, step (d) would be unnecessary.

In another embodiment, the present invention relates to a method of cleaning steam generator sludge using chemical cleaning solutions based on non-persistent complexing agents, preferably hydroxamic acids, followed by the substantial decomposition of the non-persistent complexing agents by means of thermal or chemical-thermal treatments prior to final disposal of the radioactive or heavy metal contaminants.

More specifically, the chemical cleaning process according to this embodiment comprises at least the first two, and possibly all, of the series of steps similar to those described for the previous embodiment. Additives in sludge dissolution, according to the present invention, may be selected from those listed above.

In yet another embodiment, the present invention relates to a method of removal of dissolved radioactive species or heavy metals from aqueous streams using solid sorption or ion exchange media based on non-persistent complexing agents supported on solid materials, followed by the substantial decomposition of the non-persistent complexing agents by means of thermal or chemical-thermal treatments at temperatures not exceeding about 170° C., preferably not exceeding about 150° C., most preferably not exceeding about 120° C. prior to final disposal of the radioactive or heavy metal contaminants, substantial decomposition being defined as used above. The temperature of such treatments are preferably carried out above room temperature, more preferably above about 20° C. It is preferred that the operational time of decomposition be in the range of about one hour or less.

The use of supported hydroxamic acids and related reagents to remove metal ions from solutions has been reported. For instance, D. M. Romanova, I. N. Azerbaev and K. B. Lebedev showed that copper and nickel can be sorbed on poly(Hydroxamic acid) polymers in the pH 1–6 range (Tr. Inst. Met. Obogashch., Akad. Nauk Kaz. SSR 1972, No. 48, pp. 37–42; Chem. Abstr., 80:95161w (1973)). F. Vernon and T. W. Kyffin used an ion exchanger containing N-substituted hydroxylamine functional groups to separate iron(III), copper(II) and uranyl(II) from salt solutions (Anal. Chim. Acta, 94, 317–322 (1977)). R. Bhatnagar, M. K. Sahni and N. K. Mathur used an ethylene-ethylenediamine-hydroxylaminemaleic anhydride copolymer for the concentration and separation of iron(III), cobalt (II), nickel (II), zinc(II) and copper(II) and for the separation of iron(II) from iron(III) (Proc. Ion-Exch. Symp. 1978, pp. 37–39, Chem. Abstr., 91: 141485c (1979)). V. Grdinic and N. Kujundzic used hydroxamic cellulose fibers to remove iron(III) from solutions (Croat. Chem. Acta, 54, 109–113 (1981)). F. Vernon used poly(hydroxamic acid) resin columns to strip titanium, zirconium, vanadium, molybdenum and bismuth from uranium solutions in nitric acid (Pure Appl. Chem., 54, 2151–2158 (1982)). F. Vernon and T. Shah used poly(amidoxime)/poly(hydroxamic acid) resins and fibers to extract uranium from seawater (React. Polym., 1, 301–308 (1983)). T. E. Vertinskaya, G. V. Kudryatsev, T. I. Tikhomirova and V. I. Fadeeva used silica-supported hydroxamic acid was used to sorb iron(III), scandium(III), titanium(IV), zirconium, hafnium and thorium from hydrochloric acid solutions (Russ. J. Anal. Chem., 40, 1387–1393 (1985)). A. Shah and S. Devi used poly(hydroxamic acid) 4-vinylpyridine/acrylonitrile resins to remove copper(II), cadmium(II) and zinc(II) from solutions (Ind. J. Chem., 25A, 506–508 (1986)). R. Mendez and V. N. S. Pillai used a styrene-maleic acid resin co-polymer crosslinked with divinylbenzene and having hydroxamic acid functional groups to separate copper(II), chromium(III) and iron(III) from chromium plating baths (Talanta, 37, 591–594 (1990)).

In this embodiment, the low stability of hydroxamic acids is exploited in a process whereby dissolved radioactive species or heavy metals are removed from solution using a material comprising one or more non-persistent complexing agents, preferably hydroxamic acids, supported on a solid, in batch mode or, preferably, in the form of a packed column or a bed used in a continuous or semicontinuous fashion whereby the spent solid is subsequently subjected to thermal or chemical-thermal treatments at temperatures not exceeding about 170° C. preferably not exceeding about 120° C. to decompose said complexing agents prior to final disposal of the radioactive or heavy metal contaminants. This process provides an effective means to prevent the introduction of significant amounts of complexing or chelating agents into waste disposal sites.

For the purpose of the present invention, a solid based on non-persistent complexing agents is defined as a solid on which one or more non-persistent complexing agents are supported, sorbed, or attached, at a total concentration of at least about 0.1% (wt./vol.), preferably at least about 1%, by weight based on the dry weight of the solid, and in which the ratio of the concentrations of such complexing agents to those of other organic complexing or chelating agents is at least about 10:1, preferably at least about 100:1.

The solid according to this embodiment of the present invention preferably has a surface to weight ratio of at least about 0.1 $m^2/g$, most preferably about 5 $m^2/g$. Although non-porous solids with relatively low surface-to-weight ratio such as sand may be used, it is more preferable to use solids with significant porosity and a high surface-to-weight ratio. Such solids include, but are not limited to, silica gel, zeolites, clays, and porous glasses. The most preferred solids are found to be activated carbon or charcoal and alumina, preferably basic alumina.

Removal of radioactive or heavy metal species from a solution using a combination of a non-persistent complexing agent, preferably a hydroxamic acid, and a solid support, according to the present invention, may be effected in several different ways. One or more non-persistent complexing agent may be added to the solution contaminated with radioactive or heavy metal species, and the treated solution contacted with the solid in batch form or, preferably, in the form of a packed column or a bed. Most preferably, however, the solid is pre-treated with a solution comprising one or more non-persistent complexing agent prior to contacting the pre-treated solid with the solution contaminated with radioactive or heavy metal species.

Thermal decomposition of the non-persistent complexing agents such as hydroxamic acids on the solid support may be carried out following pre-drying, for example air-drying at low temperature such as ambient temperature; preferably, however, no pre-drying is carried out since the presence of residual water can promote the decomposition of the non-persistent complexing agents. It is believed, without limiting the scope of the invention, that this promotion effect involves high-temperature hydrolysis.

More specifically, according to this embodiment, the present invention relates to a process of removing radioactive or heavy metal contamination from solutions comprising the steps of:

(a) contacting the contaminated solution with a non-persistent complexing agent supported solid, wherein the contamination comprises radioactive or heavy metal species and non-persistent complexing agent is one or a combination of hydroxamic acids, such that the radioactive or heavy metal species is essentially removed from the solution, the contact taking place at a temperature range above bout 5° C. and below about 100° C. and for a time sufficient to effect decontamination as defined above; and (b) heating the solid containing radioactive or heavy metal species resulting from step (a) to a temperature not exceeding about 170° C., preferably not exceeding about 120° C. to cause substantial decomposition, as defined herein, of the non-persistent complexing agents prior to disposal of the solid, wherein the heating is carried out under any of the following conditions:

(i) preferably, heating the solution from step (a) without any further treatment, most preferably also without thorough pre-drying;

(ii) treating or impregnating the solute with a solution of one or more acidic solutes, such as hydrochloric acid or nitric acid, or one or more basic solutes, or one or more oxidizing solutes, prior to heating;

(c) disposing of the solution and solids of steps (b).

In case (ii) the solution used to treat or impregnate the solid to assist in the thermal decomposition of the non-persistent complexing agent is subsequently removed or evaporated prior to disposal of the solid.

Certain embodiments of the present invention are described in further detail by reference to the following non-limiting Examples.

EXAMPLES

Example 1

Treatment of Surfaces

Four metal discs were used to test the effectiveness of a non-persistent complexing agent in surface decontamination. Two of the discs were made out of 304 L stainless steel. Each of these two had a diameter of 0.5" and a thickness of 0.106". The other two discs were made out of C1020 carbon steel. Each of these two had a diameter of 0.5" and a thickness of 0.132". Each of the four discs was suspended for a period of 30 seconds in a solution of Co-60 (as cobalt chloride) in water. The discs were air-dried overnight and counted by means of a lithium-drifted germanium detector to determine the level of contamination with the Co-60 gamma emitting isotope. One of the discs of each type of steel was then immersed for 20 minutes at a temperature of 80° C. in 10 mL of a solution of 150 g/L acetohydroxamic acid in water. The second disc of each type of steel was immersed for 20 minutes at a temperature of 80° C. in 10 mL of a solution of 150 g/L ethylenediaminetetraacetic acid (EDTA) disodium salt in water. Each disc was then dried for two hours and counted again on the lithium-drifted germanium detector.

The results of the experiment showed that in the case of the C1020 carbon steel discs, the extent of decontamination, as reflected in the fractional decrease in Co-60 gamma activity, was 74% when the EDTA solution was used and 72% when the acetohydroxamic acid solution was used. In the case of the 304 L stainless steel discs, the extent of decontamination was 80% when the EDTA solution was used and 88% when the acetohydroxamic acid solution was used.

Example 2

Treatment of Sludge

Two samples of steam generator sludge were obtained from the Consolidated Edison Company of New York Indian Point 2 power plant. One of these samples contained about 74% of iron oxides, about 16% of copper and its oxides, about 2% each of zinc oxide and alumina, the balance consisting of a variety of minor oxides. The first sample consisted of powder and had a high proportion (about 4:1) of hematite to magnetite, while the second sample consisted of pellets and had a much lower proportion (less than 1:1) of hematite to magnetite. Two chemical cleaning solutions were prepared. One of them, based on the iron solvent composition recommended by the Electric Power Research Institute, contained 150 g/L of ethylenepdiaminetetraacetic acid (EDTA) disodium salt and 10 g/L of hydrazine (introduced as hydrazine sulfate) with the pH adjusted to 6.8 with ammonium hydroxide. The other solution only contained 150 g/L of acetohydroxamic acid and its pH was found to be 6.8 even though neither hydrazine nor ammonia was added.

A quantity of 1 g of each of the steam generator sludge samples was treated with 20 mL of one of the two chemical cleaning solutions at a temperature of 70° C. for 24 hours. The amount of sludge dissolution was determined in each case by measuring the concentration of iron in each solution following centrifugation of the remaining sludge.

The results showed that in the case of the powder sludge samples with the high hematite to magnetite ratio, the fractional amount of dissolution was 34% upon using the EDTA solution and 11% upon using the acetohydroxamic acid solution. In the case of the sludge pellets with the low hematite to magnetite ratio, the fractional amount of dissolution was 57% upon using the EDTA solution and 56% upon using the acetohydroxamic acid solution.

Example 3

Treatment of Solution With Additives

A solution of 7.5 g/L acetohydroxamic acid in deionized water was prepared. Volumes of this solution were treated with various acids, or with solid powders, to evaluate the effect of these additives on the thermal decomposition of acetohydroxamic acid. The concentration of remaining acetohydroxamic acid was determined at the end of each experiment and compared with the initial concentration, the analytical determination being performed by adding 1 mL of a solution of 20 g ferric chloride ($FeCl_3$) in a liter of 2% hydrochloric acid and monitoring the intensity of the red coloration produced at a wavelength of 630 nm.

In a series of experiments carried out at a temperature of 90° C. for two hours, it was found that the addition of 1 mL of concentrated hydrochloric acid to 20 mL of solution caused a decomposition of more than 98.5% of the acetohydroxamic acid and that the addition of concentrated nitric acid caused a decomposition of 97.5% of the acetohydroxamic acid. Treatment of 20 mL of solution with 2 mL of concentrated hydrochloric acid at 100° C. caused more than 99% decomposition.

In a series of experiments carried out at a temperature of 90° C. for a period of 1 hour, it was found that the addition of 2 g of cerium dioxide or chromium trioxide to the acetohydroxamic acid solution caused no significant decrease in the concentration of acetohydroxamic acid in the solution. On the other hand, the addition of manganese dioxide under the same conditions resulted in more than 98% decomposition of the acetohydroxamic acid solution and the addition of argentic oxide resulted in more than 96% decomposition. Treatment of 20 mL of the acetohydroxamic acid solution with 4 g of either finely powdered manganese dioxide or activated technical graded manganese dioxide at 100° C. for 2 hours resulted in more than 98% decomposition. Using activated manganese dioxide, the majority of the acetohydroxamic acid was decomposed even upon contact of less than one hour at temperatures as low as 50° C.

Example 4

Treatment of Solution with Different Supports

An aqueous solution of 5.0 mg/L of cobalt was prepared by dissolving cobalt nitrate hexahydrate in water. Supported hydroxamic acid solids were prepared by treating 4 g of basic alumina or of activated carbon with 20 mL of a solution of 7.5% acetohydroxamic acid in water. Volumes of 20 mL of the cobalt solution were treated with 2 mL of the wet supported acetohydroxamic acid solids for 30 minutes at room temperature. Subsequently, the solutions were separated from the solids by centrifugation, and the concentration of cobalt in the solution was measured by means of dc plasma emission spectroscopy. It was found that the treatment of the solution with the acetohydroxamic acid supported on basic alumina reduced the concentration of cobalt in the solution to (3.89±0.06) mg/L, while the treatment of the solution with the acetohydroxamic acid supported on activated carbon reduced the concentration of cobalt in the solution to (2.92±0.06) mg/L. The cobalt-loaded solids were then heated to a temperature of 170° C. to decompose the acetohydroxamic acid, based on a separate experiment that showed that heating solid hydroxamic in air at a temperature of 150° C. for one hour results in decomposition of the bulk of the acetohydroxamic acid, while heating at 175° C. for one hour results in complete decomposition. Thermal decomposition is more effective when a small amount of water is initially added to the hydroxamic acid.

Documents cited hereinabove are incorporated, in their entirety, by reference.

The present invention has been described in some detail for purposes of clarity and understanding. However, one skilled in the art will appreciate from a reading of this disclosure that various changes in form and detail can be made without departing from the true scope of the invention.

What is claimed is:

1. A process for decontamination of solid surfaces contaminated with radioactive or heavy metal species using a solution based on one or more non-persistent complexing agents, said complexing agents being capable of being substantially decomposed by means of thermal or chemical-thermal treatments at a temperature not exceeding about 120° C., and being present in said solution at a concentration of at least about 0.1%, wherein said non-persistent complexing agents are hydroxamic acids, said process comprising applying said solution to the contaminated solid surface, and subsequently heating said solution to a temperature not exceeding about 120° C. to cause substantial decomposition of said non-persistent complexing agents.

2. The process according to claim 1 where said temperature does not exceed about 100° C. and the heating time does not exceed about 2 hours.

3. The process of claim 1 where said non-persistent complexing agents are is acetohydroxamic acid.

4. The process of claim 1 further comprising adding an acid, a base, or an oxidant to said solution prior to said heating.

5. The process of claim 1 where said heating is carried out when said solution is in contact with a solid reagent.

6. The process of claim 5 where said solid reagent is a packed column or a bed.

7. The process of claim 5 where said solid is manganese oxide.

8. The process of claim 1 where said heating is followed by contacting said solution with one or more sorption or ion exchange media to cause substantial removal of said radioactive or heavy metal species from said solution.

9. The process of claim 1 where said heating is followed by distilling said solution to cause substantial removal of said radioactive or heavy metal species from said solution.

10. A process for chemical cleaning of steam generator sludge contaminated with radioactive or heavy metal species using a solution based on one or more non-persistent complexing agents, said complexing agents being capable of being substantially decomposed by means of thermal or chemical-thermal treatments at a temperature not exceeding about 120° C., and being present in said solution at a concentration of at least about 0.1%, wherein said non-persistent complexing agents are hydroxamic acids, said process comprising applying said solution to said steam generator sludge, and subsequently heating said solution to a temperature not exceeding about 120° C. to cause substantial decomposition of said non-persistent complexing agents.

11. The process according to claim 10 where said temperature does not exceed about 90°–100° C. and the heating time does not exceed about 1–2 hours.

12. The process of claim 10 where said non-persistent complexing agent is acetohydroxamic acid.

13. The process of claim 10 further comprising adding an acid, a base, or an oxidant to said solution prior to said heating.

14. The process of claim 10 where said heating is carried out when said solution is in contact with a solid reagent.

15. The process of claim 14 where said solid reagent is a packed column or a bed.

16. The process of claim 14 where said solid is manganese oxide.

17. The process of claim 10 where said heating is followed by contacting said solution with one or more sorption or ion exchange media to cause substantial removal of said radioactive or heavy metal species from said solution.

18. The process of claim 10 where said heating is followed by distilling said solution to cause substantial removal of said radioactive or heavy metal species from said solution.

19. A process for removing radioactive or heavy metal species from a solution using a combination of a one or more non-persistent complexing agents and a solid support, said complexing agents being capable of being substantially decomposed by means of thermal or chemical-thermal treatments at a temperature not exceeding about 170° C., wherein said non-persistent complexing agents are hydroxamic acids, said process comprising contacting said solution with said solid support in the presence of said non-persistent complexing agents, and subsequently heating said solid support to a temperature not exceeding about 170° C. to cause substantial decomposition of said non-persistent complexing agents.

20. The process of claim 19 where said non-persistent complexing agents is acetohydroxamic acid.

21. The process of claim 19 where said solid support is pre-treated with a solution containing said non-persistent complexing agents to support said non-persistent complexing agents on said solid prior to contact with said solution containing radioactive or heavy metal species.

22. The process of claim 19 where said solid support is a packed column or a bed.

23. The process of claim 19 where said heating is carried out following treatment of said solid support with a solution containing one or more acidic solutes, basic solutes, or oxidizing solutes.

24. A process for decontamination of solid surfaces contaminated with radioactive or heavy metal species using a solution based on one or more non-persistent complexing agents, said complexing agents being capable of being substantially decomposed by means of thermal or chemical-thermal treatments at a temperature not exceeding about 120° C., and being present in said solution at a concentration of at least about 0.1%, said process comprising applying said solution to the contaminated solid surface, adding an acid or a base to said solution and subsequently heating said solution to a temperature not exceeding about 120° C. to cause substantial decomposition of said non-persistent complexing agents.

25. The process according to claim 24, where said temperature does not exceed 100° C. and the heating time does not exceed about 2 hours.

26. The process according to claim 24, where said non-persistent complexing agent is acetohydroxamic acid.

27. The process according to claim 24 where said heating is carried out when said solution is in contact with a solid reagent.

28. The process according to claim 27 wherein said solid reagent is a packed column or a bed.

29. The process of claim 27 wherein said solid is manganese oxide.

* * * * *